US009771194B1

(12) United States Patent
Lefkovitz

(10) Patent No.: US 9,771,194 B1
(45) Date of Patent: Sep. 26, 2017

(54) METERED, BLENDING PORTABLE BEVERAGE CONTAINER

(71) Applicant: Joshua Lefkovitz, Akron, OH (US)

(72) Inventor: Joshua Lefkovitz, Akron, OH (US)

(73) Assignee: ZING ANYTHING LLC, Akron, OH (US)

( * ) Notice: Subject to any disclaimer, the term of this patent is extended or adjusted under 35 U.S.C. 154(b) by 0 days.

(21) Appl. No.: 13/779,778

(22) Filed: Feb. 28, 2013

(51) Int. Cl.

| | |
|---|---|
| ***B67D 7/74*** | (2010.01) |
| ***B67D 7/60*** | (2010.01) |
| ***G01F 11/00*** | (2006.01) |
| ***B65D 25/08*** | (2006.01) |
| ***B65D 51/28*** | (2006.01) |

(52) U.S. Cl.
CPC ..... *B65D 51/2807* (2013.01)

(58) Field of Classification Search
USPC ..... 222/129, 390; 206/219, 221; 220/521; 141/112, 320; 169/82, 83, 78
See application file for complete search history.

(56) References Cited

U.S. PATENT DOCUMENTS

| | | | | |
|---|---|---|---|---|
| 1,691,024 | A * | 11/1928 | Gedge | 401/173 |
| 2,786,769 | A * | 3/1957 | Greenspan | 426/117 |
| 3,404,811 | A | 10/1968 | Cernei | |
| 3,432,078 | A * | 3/1969 | Hall | 222/80 |
| 4,005,699 | A * | 2/1977 | Bucalo | 600/12 |
| 4,473,097 | A | 9/1984 | Knickerbocker et al. | |
| 4,863,072 | A * | 9/1989 | Perler | 222/390 |
| 6,182,865 | B1 | 2/2001 | Bunschoten et al. | |
| 6,290,100 | B1 | 9/2001 | Yacko et al. | |
| 6,561,232 | B1 * | 5/2003 | Frutin | 141/9 |
| 6,655,557 | B2 * | 12/2003 | Rousselet et al. | 222/391 |
| 6,843,368 | B1 | 1/2005 | Frutin | |
| 7,066,323 | B1 | 6/2006 | Reisman | |
| 7,172,095 | B2 * | 2/2007 | Marshall | 222/83 |
| 7,331,486 | B2 | 2/2008 | Mon et al. | |
| 7,377,383 | B2 | 5/2008 | Henry | |
| 7,850,043 | B2 | 12/2010 | Foster | |
| 7,896,180 | B2 * | 3/2011 | Kenney | 215/6 |
| 7,992,735 | B2 | 8/2011 | Bullard et al. | |
| D649,883 | S | 12/2011 | Foster | |
| 8,157,131 | B2 | 4/2012 | Sim | |
| 2002/0066679 | A1 | 6/2002 | Moscovitz | |
| 2006/0113201 | A1 | 6/2006 | Micic et al. | |
| 2006/0219736 | A1 * | 10/2006 | Revenu | 222/129 |
| 2007/0125668 | A1 * | 6/2007 | Marshall | 206/219 |
| 2007/0199838 | A1 * | 8/2007 | Oh et al. | 206/219 |
| 2008/0289976 | A1 | 11/2008 | Henry | |
| 2011/0089059 | A1 * | 4/2011 | Lane et al. | 206/222 |
| 2013/0327788 | A1 * | 12/2013 | Roth et al. | 222/83 |

FOREIGN PATENT DOCUMENTS

| | | |
|---|---|---|
| WO | WO 97/16101 | 5/1997 |

* cited by examiner

*Primary Examiner* — J. Casimer Jacyna
*Assistant Examiner* — Benjamin R Shaw
(74) *Attorney, Agent, or Firm* — John D. Gugliotta

(57) ABSTRACT

A drinking vessel is provided with a nesting reservoir system for containing and dispensing metered amounts of liquid beverage enhancer. Multiple metered doses can be dispensed, with multiple refilling of the drinking vessel. The concentrated enhancer is metered by the rotation of a knob that rotates a plunger mechanism into a reservoir volume chamber, with one rotation being calibrated to deliver a single dosage of liquid enhancer. All parts can be easily removed, cleaned and then re-used.

10 Claims, 3 Drawing Sheets

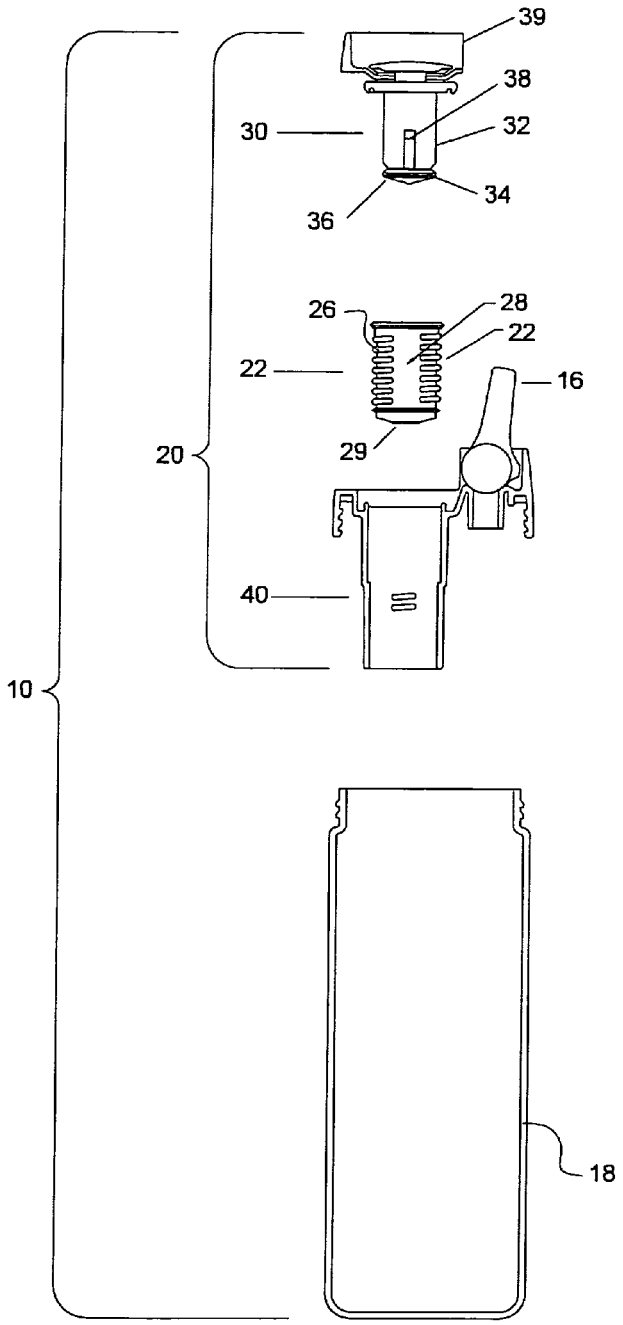
FIG. 7
FIG. 5
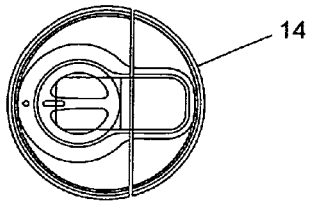
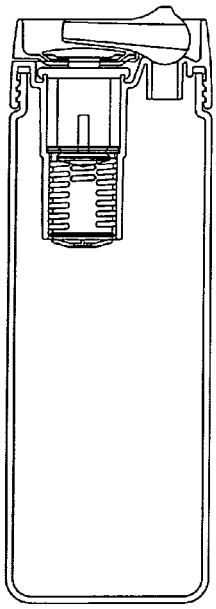
FIG. 6

METERED, BLENDING PORTABLE BEVERAGE CONTAINER

RELATED APPLICATIONS

There are no previously filed, nor currently any co-pending applications, anywhere in the world.

BACKGROUND OF THE INVENTION

1. Field of the Invention

This invention relates to the field of beverage containers and, more particularly, to a reusable and portable beverage bottle adapted for the metering and blending of dosages of beverage mix therein.

2. Description of the Related Art

Bottled water has become widely available and of dramatically increasing popularity over the past several decades. Recent estimates have a valuation of global bottle water sales of around $60 billion and a volume of more than 115,000,000 cubic meters ($3.0\times10^{10}$ US gal) in 2006. Sales in the United States alone have reached around 30 billion bottles of water in 2008, with the rate of consumption having more than quadrupled between 1990 and 2005. By one estimate, approximately 50 billion bottles of water are consumed per annum in the U.S. and around 200 billion bottles globally.

With such popularity has come some controversy about the potential health effects of bottled water. In the United States, bottled water and tap water are regulated by different federal agencies: the Food and Drug Administration (FDA) regulates bottled water and the Environmental Protection Agency (EPA) regulates the quality of tap water.

Issues surrounding tap water can exist that although the Safe Drinking Water Act regulates a set maximum contaminant levels for approximately 90 contaminants that might be found in drinking water and 15 secondary maximum contaminant levels, the addition of fluoride treatment to tap water to prevent tooth decay has been a main target of controversy used to encourage bottled water distribution. Since bottled water processed with distillation or reverse osmosis lacks fluoride ions which are present in some natural ground water. In contrast, the drinking of distilled water may increase the risk of tooth decay due to a lack of this element now added to many water supplies.

Similarly, issues surrounding bottled water also exist. According to a 1999 NRDC study, roughly 22 percent of brands were tested in which at least one sample of bottled drinking water contained chemical contaminants at levels above strict state health limits. Some of the contaminants found in the study could pose health risks if consumed over a long period of time. The NRDC report conceded that "most waters contained no detectable bacteria, however, and the level of synthetic organic chemicals and inorganic chemicals of concern for which [they] were tested were either below detection limits or well below all applicable standards."[1]

[1]Natural Resources Defense Counsel: http://www.nrdc.org/water/drinking/bw/bwinx.asp Another rapidly growing concern evolving around bottled water is the non-sustainability surrounding the use of the plastic containers themselves in that a high percentage of the bottled water contained in plastic containers land filled after use. Additionally, although some bottled water is contained in glass, researchers believe some water in the plastic containers may leach chemicals into the water from the plastic containers.[2] Leaching of chemicals into the water is felt to be related to the plastic bottles being exposed to either low or high temperatures.

[2]UPI.com "Heath News": http://www.upi.com/Health_News/2009/03/27/Estrogenic-chemicals-in-bottled-water/UPI-85521238211685/?feature=global_water In addition, a new trend in the bottled or tap water beverage market is the emergence of a new product category of "liquid water enhancers". Typical of such products is the MiO™ liquid drink enhancer provided by Kraft Food Group Inc. MiO™ is a zero calorie liquid beverage mix that offers artificially sweetened beverage options in multiple flavors. Originally released by Kraft Foods in March 2011, new products, such as MiO Energy™ have been launched in 2012, and MiO FIT™ being launched this year.

The use of liquid water enhancers require the purchased of bottled water, or the use of tap water into reusable drinking containers. However, to date there have been no containers that have been specifically adapted such effective and efficient use.

Some containers are known that incorporate various mechanisms for mixing or metering a solution into a common liquid container. For example:

PCT International Phase Publication WO 97/16101, published in the name of Scudder, describes a container that has both a liquid and a solid, separated in different cavities. A breakable diaphragm dividing the two causes mixing when broken. This structure is designed for a self heating, or self cooling liquid container.

U.S. Pat. No. D649,883, issued in the name of Foster, discloses a container in which a secondary chamber is located within the base and internal to the primary contained fluid volume.

U.S. Pat. No. 7,850,043, also issued in the name of Foster, discloses a self contained mixing and dispensing container having a secondary metering chamber that dispense a metered amount of liquid through a diaphragm.

U.S. Patent Publication US2008/0289976, published in the name of Henry, describes a secondary mixing chamber that is attachable to the mouth of a water (or milk) bottle. Mixing is accomplished by pouring through the secondary chamber.

U.S. Patent Publication US2006/0113201, published in the name of Micic et al., described a drinking bottle having a flavor concentrate container. A metering means activated by a thumb screw portions concentrate into the main fluid chamber.

U.S. Pat. No. 7,066,323, issued in the name of Reisman, describes interlocking beverage mixing containers in which a mouth of a second container is threaded into the bottom of the first and forces open a seal, thereby allowing mixing between the two chambers.

U.S. Pat. No. 3,404,811, issued in the name of Cernei, discloses a similar dual threaded container. However, in this version the two chambers are separately designed units, intended to be connected as a unit and separated by a spacer until broken to use.

U.S. Pat. No. 6,843,368, issued in the name of Frutin, discloses a device for metering an additive into a liquid package in which a plunger releases a concentrated through a syringe like dip tube into the main liquid container.

U.S. Patent Publication US2002/0066679, published in the name of Moscovitz, discloses a secondary container, attachable to the mouth of a bottle, holding a flavoring concentrate through the use of a breakable barrier. A plunging mechanism breaks the barrier after connected and sealed.

And, U.S. Pat. No. 7,992,735, issued in the name of Bullard et al., discloses a storage and mixing container that inserts coanularly within a main chamber and releases contents when depressing a plunger mechanism.

It is preferable that a beverage container that is adapted and configured for the blending of liquid water enhancer into a beverage volume of water would provide for: a removable, cleanable and refillable reservoir for adding concentrated liquid to water; a system for the measured metering of multiple doses of such concentrated, thereby allowing for the main bottle to be refilled several times with water without need for refilling the reservoir; and allow for all parts to be easily removed, cleaned and reused. Consequently, a need has been felt for providing an apparatus and method which provides an improved water bottle adapted for the metering and blending of dosages of beverage mix therein.

SUMMARY OF THE INVENTION

It is therefore an object of the present invention to provide an improved beverage bottle It is a feature of the present invention to provide an improved water bottle adapted for the metering and blending of dosages of beverage mix therein.

Briefly described according to one embodiment of the present invention, a beverage bottle is provided that is adapted for the metering and blending of dosages of beverage within a container such as a water bottle. A storage and metering assembly that integrates with a sealing lid of the water bottle is formed of three basic components formed to nest within the water bottle. These are a reservoir cup; a removable plunger assembly; and a main lid assembly. The assembly receives liquid beverage enhancer in a multiple dose volume. The plunger assembly is formed to be nestingly received within the reservoir cup such that a sealing stopper terminating at a lower end by a plunger head is pulled into the reservoir every time an upper plunger knob is turned. The plunger head is designed to be sealingly received within the inner volume and against the inner sidewall of the reservoir cup. Upon one direction of rotation the sealing stopper is drawn down into the reservoir cup and thereby causes displacement of this metered volume through a diaphragm valve or other type of one way valving mechanism.

It is an object of this invention to provide a for a beverage container that allows for metering of multiple doses of liquid water enhancer into a drinking water reservoir.

It is another object of the present invention to provide for such a metering and mixing container that can deliver measured, multiple doses of concentrate, thereby allowing the main drinking volume to be refilled with water several times.

It is another object to provide a container having a drinking straw that is integrated into the container as a cap at the top of the container is removed from its closed position.

It is yet another object to provide a container having a removable, cleanable and refillable reservoir for adding concentrated liquid to a volume of beverage.

A further feature of this invention is to provide a mechanism that can be easily removed, cleaned and then reused.

Yet another object of the present invention is to enable such a mechanism that is adaptable to be incorporated in existing bottled water bottles for disposable use.

Further features of the invention will become apparent in the course of the following description.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

FIG. 5 is a top plan view thereof;

FIG. 6 is a cross sectional elevational view taken along line VI-VI of FIG. 3;

FIG. 7 is an exploded cross sectional view of FIG. 6; and

DESCRIPTION OF THE PREFERRED EMBODIMENTS

Figures 1, 2, 3, 4:
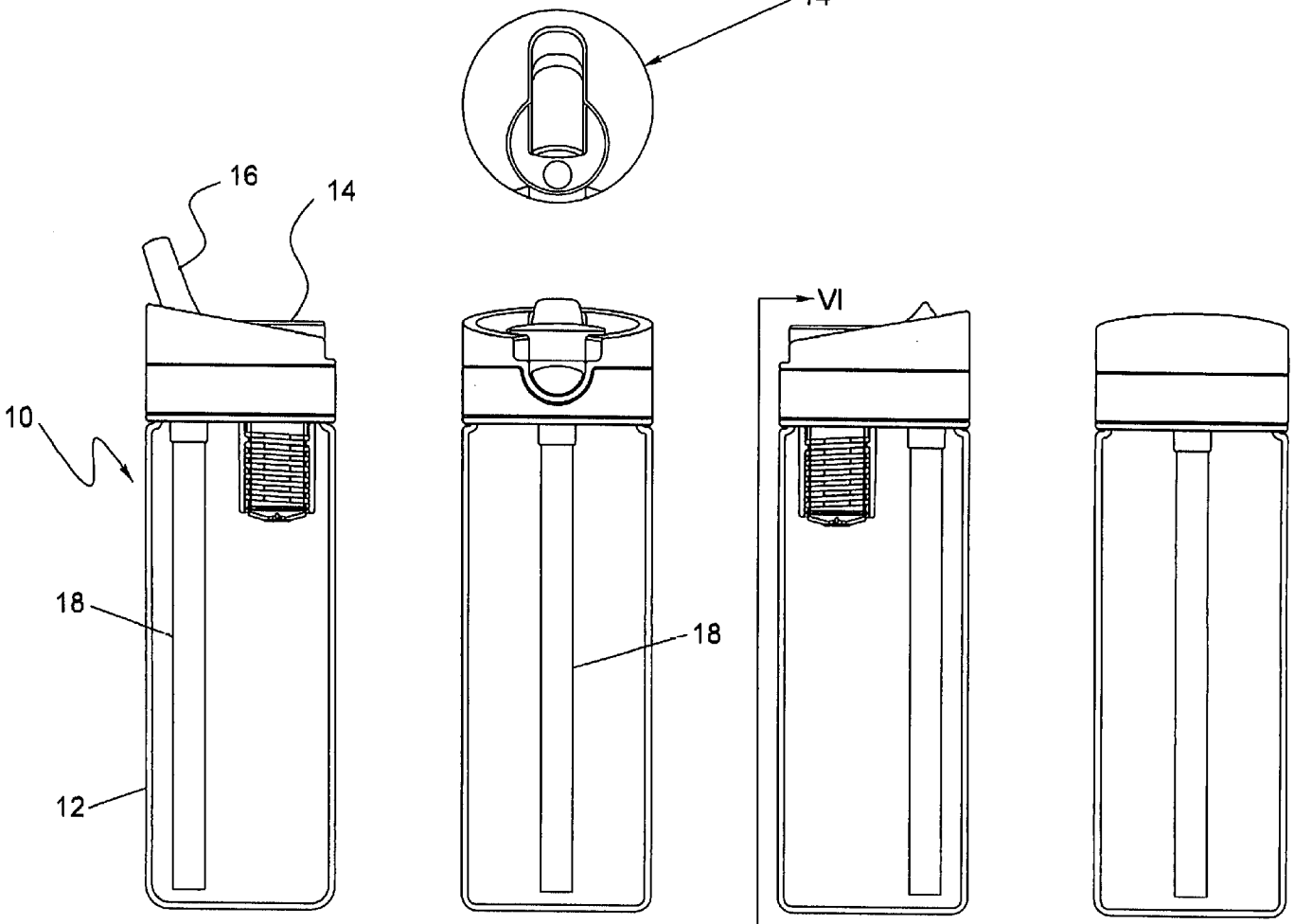
FIG. 1 is a right side elevation of a water bottle straw cap according to the preferred embodiment of the present invention.
FIG. 2 is front elevational view thereof.
FIG. 3 is a left side elevational view thereof.
FIG. 4 is a rear elevational view thereof.

The best mode for carrying out the invention is presented in terms of its preferred embodiment, herein depicted within the Figures.

1. Detailed Description of the Figures

Referring first to FIG. 1-6, a portable beverage container, generally noted as 10, is provided for the reusable metering and blending of dosages of beverage mix into a volume of drinking beverage according to the preferred embodiment of the present invention. As should be apparent to a person having ordinary skill in the relevant art, in hindsight light of the present teachings, that the preferred embodiment as shown is utilized in a water bottle configuration having a water bottle 12 sealingly closed by a cap 14 incorporation a drinking spout 16 and draw tube or straw 18 intended for multiple, refilled use. However, such a skilled person, in light of the present teachings, should also understand that such a selection of design merely supports the intended use, and that the teachings and innovations provided herein may also be adapted for use with other types of beverage containers including, but not limited to, to those disposable water bottled provided with prepackaged, retail bottled water. In light of these examples, the water bottle 18 is shown for receiving a volume of beverage liquid such as water (not shown). The dip tube or straw 18 are intended to provide fluid communication to the spout 16 and allow access by the user by creating suction, rather than by inverting the entire assembly 10. Such a means and mechanism are in way intended to be limiting, and in such a configuration the spout 16 is incorporated within the cab assembly 16, along with a beverage enhancer storage and metering assembly 20.

The storage and metering assembly 20 is intended for containing a liquid water enhancer such as, for example, the MiO™ liquid drink enhancer as provided by Kraft Food Group Inc., or other functionally similar or equivalent products or product line extension of the type intended to be mixed or blended with a separately metered volume of a beverage fluid. It is assumed that the separately metered volume of beverage fluid could be refilled with a beverage fluid such as, for example, water several times without refilling the storage and metering assembly 20. As such, it is assumed that the volume for storage of beverage enhancer is smaller than the volume of the beverage fluid.

As shown in greater detail in FIG. 6 and in conjunction with FIG. 7, the storage and metering assembly 20 if formed of three basic components formed to nest within the water bottle 12: a reservoir cup 22; a removable plunger assembly 30; and a main lid assembly 40. The assembly 20 is adapted for receiving a volume liquid beverage enhancer capable of multiple doses with a reservoir cup 22. The reservoir cup 22 has an inner sidewall forming a threading 26, as well as a vertically linear guide 28. The plunger assembly 30 is formed to be nestingly received within the reservoir cup 22 and has a sealing stopper 32 terminating at a lower end by a plunger head 34. The plunger head 34 is designed to be sealingly received within the inner volume and against the inner sidewall of the reservoir cup 22. The outer circumferential edge 36 of the plunger head 34 is received between adjacent threads 26 when the sealing stopper 32 is rotated. Further, upon one direction of rotation the sealing stopper 32 is drawn down into the reservoir cup 22 and thereby causes displacement of any fluid volume therein through a diaphragm valve 29 or other type of one way valving mechanism. An index guide 38, formed into and protruding from the sidewalls of the sealing stopper 32, nests into and is guided by the vertically linear guide 28. In such a configuration, the rotation of the sealing stopper 32 by a knob 39 terminating the upper end of the stopper 32 is used to meter a displaced volume of contained liquid from the reservoir cup 22.

The reservoir cup 22 fits down within the main lid assembly 40. Similarly, the removable plunger assembly 30 is retained by the upper end of the main lid assembly 40.

It is envisioned that the ease of installation and subsequent removal of the entire storage and metering assembly 20 and its component reservoir cup 22, plunger assembly 30 and a main lid assembly 40 will allow for all parts to be easily removed, cleaned and re-used.

2. Operation of the Preferred Embodiment

Figure 8D:
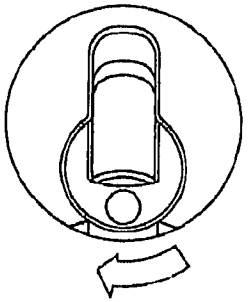
FIG. 8*a* through FIG. 8*d* are partial exploded schematic views illustrating steps 1 though 4 of the operation of the preferred embodiment of the present invention.
Figure 8C:
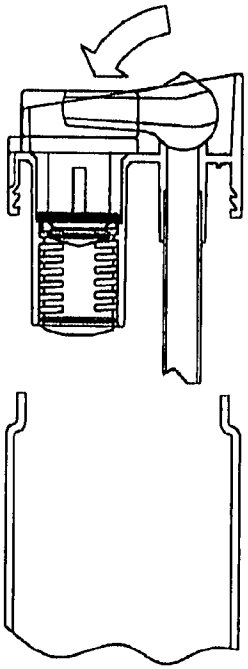

By way of example, and not as a limitation, in accordance with a preferred embodiment of the present invention, rotation of the knob 39 relative to the bottle 12 is used to meter liquid beverage enhancer into a beverage fluid. In this manner the multi-use volume of concentrate is ejected in measured amounts, allowing for incremental infusion to be administered directly by the user. Such a method of use of the preferred embodiment of the present invention is best described in conjunction with FIG. 8*a* through 8*d*, in which water received and retained within the bottle 12 can be enhanced for flavor or contents. To accomplish this, the main lid assembly 40 is first inserted into the lid 14 and the reservoir cup 22 is inserted into the main lid assembly 40. See FIG. 8*a*, Step 1. The reservoir cup is then filled with a volume of liquid beverage enhancer. By way of example, and not as a limitation, the use of a volume of liquid beverage enhancer intended for multiple portions of beverage is envisioned and described.

Figure 8B:
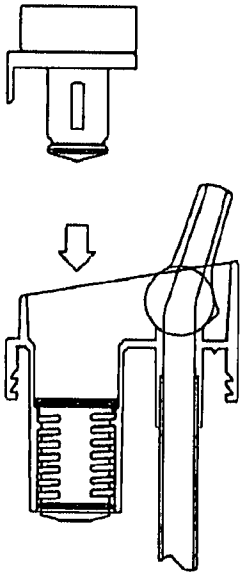
Figure 8A:
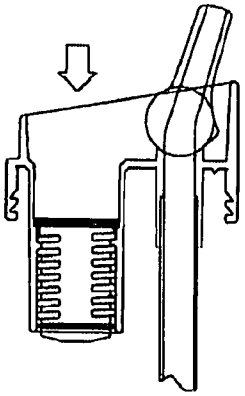

As show in FIG. 8*b* (Step 2), the removable plunger assembly 30 is then snapped onto the main lid assembly 40 with the sealing stopper 32 inserted within the reservoir cup 22. The device is now primed and ready for operation. Rotation fo the knob 39 one full rotation causes displacement of one metered dose of contents within the reservoir cup 22 to be discharged through the diaphragm valve 29 and into the bottle 12.

As shown in FIG. 8*c* (Step 3), the drinking spout 16 of this particular design selection is pivotally affixed to the lid 14, and so the spout 16 is pivoted closed to further nest within the knob 39 to thereby function as a "lock" and otherwise prevent unintended additional rotation of the knob 39 (and subsequent release of additional fluid concentrate).

As finally shown in FIG. 8*d* (Step 4), each time the water bottle 12 is refilled the knob can be turned one additional rotation in order to release a subsequent metered amount of beverage enhancer contents.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the Claims appended hereto and their equivalents. Therefore, the scope of the invention is to be limited only by the following claims.

What is claimed is:

1. A beverage bottle comprising:

a fluid container for receiving and dispensing a volume of beverage liquid and sealingly closed by a cap;

a liquid beverage flavor enhancer receiving and storage chamber, wherein said receiving and storage chamber nest within said fluid container, and wherein said beverage flavor enhancer receiving and storage chamber comprises a reservoir cup said reservoir cup has an inner sidewall forming a series of threads and a vertically linear guide;

a metering assembly adapted for dispensing incremental and multiple measured amount of liquid beverage flavor enhancer from the receiving and storage chamber and into said fluid container, wherein said metering assembly cooperatively engages with said receiving and storage chamber, and said metering assembly comprises a removable plunger assembly and a main lid assembly, said plunger assembly is formed to be nestingly received within the reservoir cup, said plunger assembly further having a sealing stopper terminating at a lower end by a plunger head;

said plunger head is sealingly received within the inner volume and against the inner sidewall of the reservoir cup;

wherein a beverage liquid can thereby be incrementally infused with a liquid beverage flavor or nutrient enhancer by a user for the purposes of creating a flavored or fortified beverage.

2. The beverage bottle of claim 1, wherein an outer circumferential edge of the plunger head is received between adjacent threads when the sealing stopper is rotated.

3. The beverage bottle of claim 2, wherein said metering assembly is adapted such that upon one complete rotation of the sealing stopper causes the reservoir cup to be pulled towards the sealing stopper, and thereby causes displacement of any fluid volume therein through a valve.

4. The beverage bottle of claim 3, wherein said valve comprises a diaphragm valve.

5. The beverage bottle of claim 3, further comprising an index guide formed into and protruding from sidewalls of the sealing stopper, wherein said index guide nests into and is guided by the vertically linear guide.

6. The beverage bottle of claim 5, wherein rotation of the sealing stopper by a knob terminating the upper end of the stopper is used to meter a displaced volume of contained liquid from the reservoir cup.

7. The beverage bottle of claim 1, wherein said reservoir cup fits down within the cap and the removable plunger assembly is retained by the cap.

8. In the reusable and portable beverage bottle, the improvement comprising a nesting reservoir system for containing and dispensing metered amounts of liquid beverage enhancer, whereby multiple metered doses can be dispensed, with multiple refilling of the drinking vessel and wherein said reservoir systems comprises:

a reservoir cup having an inner sidewall forming a series of threads and a vertically linear guide; and said plunger assembly is formed to be nestingly received within the reservoir cup, said plunger assembly further having a sealing stopper terminating at a lower end by a plunger head; wherein said plunger head is sealingly received within the inner volume and against the inner sidewall of the reservoir cup.

9. In the reusable and portable beverage bottle claim 8, wherein an outer circumferential edge of the plunger head is received between adjacent threads when the sealing stopper is rotated such that upon one complete rotation of the sealing stopper causes the reservoir cup to be pulled towards the sealing stopper and thereby causes displacement of any fluid volume therein through a valve controlling egress from a bottom of the reservoir.

10. In the reusable and portable beverage bottle claim 9, further comprising an index guide formed into and protruding from sidewalls of the sealing stopper, wherein said index guide nest into and is guided by the vertically linear guide.

* * * * *